US006932036B2

(12) United States Patent
Aino et al.

(10) Patent No.: US 6,932,036 B2
(45) Date of Patent: Aug. 23, 2005

(54) ELECTROMAGNETIC BRAKE COOLING STRUCTURE OF PHASE VARIABLE DEVICE IN CAR ENGINE

(75) Inventors: Hiroshi Aino, Hadano (JP); Koichi Honma, Hadano (JP); Hiroki Morozumi, Yokohama (JP); Yousuke Mae, Yokohama (JP); Kazuhito Mukai, Chitose (JP)

(73) Assignees: Nittan Valve Co., Ltd. (JP); Nissan Motor Co., Ltd. (JP); Dynax Corporation (JP)

( * ) Notice: Subject to any disclaimer, the term of this patent is extended or adjusted under 35 U.S.C. 154(b) by 0 days.

(21) Appl. No.: 10/478,108

(22) PCT Filed: Apr. 12, 2002

(86) PCT No.: PCT/JP02/03671

§ 371 (c)(1),
(2), (4) Date: Apr. 5, 2004

(87) PCT Pub. No.: WO02/103167

PCT Pub. Date: Dec. 27, 2002

(65) Prior Publication Data

US 2005/0045127 A1 Mar. 3, 2005

(30) Foreign Application Priority Data

Jun. 15, 2001 (JP) ..... 2001-181657

(51) Int. Cl.[7] ..... F01L 1/34

(52) U.S. Cl. ..... 123/90.17; 123/90.31; 464/160

(58) Field of Search ..... 123/90.15, 90.16, 123/90.17, 90.18, 90.27, 90.31; 464/1, 2, 160; 251/129.01, 129.15, 129.16

(56) References Cited

U.S. PATENT DOCUMENTS

| | | | | |
|---|---|---|---|---|
| 4,754,727 A | | 7/1988 | Hampton | |
| 4,841,924 A | | 6/1989 | Hampton et al. | |
| 5,031,585 A | | 7/1991 | Muir et al. | |
| 5,381,764 A | * | 1/1995 | Fukuma et al. | 123/90.17 |
| 6,390,045 B1 | * | 5/2002 | Mae et al. | 123/90.17 |

FOREIGN PATENT DOCUMENTS

| | | |
|---|---|---|
| JP | 62-108635 | 7/1987 |
| JP | 63-162910 | 7/1988 |
| JP | 02-102305 | 4/1990 |
| JP | 04-087307 | 7/1992 |
| JP | 04-272411 | 9/1992 |
| JP | 08-049740 | 2/1996 |

OTHER PUBLICATIONS

International Search Report dated Jul. 30, 2002.

* cited by examiner

*Primary Examiner*—Thomas Denion
*Assistant Examiner*—Ching Chang
(74) *Attorney, Agent, or Firm*—Connoly, Bove, Lodge & Hutz LLP

(57) ABSTRACT

An electromagnetic-brake cooling structure of a phase-variable device having an electromagnetic brake means (40) and varying the phase of a camshaft, wherein engine oil in an oil sump (74) on the radial inner side of a clutch case (60) led to the relative sliding surfaces of a friction material (66) and a rotary drum (44) through a notch (61) provided in the clutch case (60) at the front edge part of the inner peripheral wall of the clutch case (60), a notch (61*b*) for leading oil to the front edge part of the clutch case outer peripheral wall (60*b*), the oil on the relative sliding surfaces of the friction material (66) and the rotary drum (44) is discharged positively to the outside, and the circulation of the cooling oil is activated to increase the cooling effect of the sliding surface of the friction material (66).

7 Claims, 8 Drawing Sheets

ELECTROMAGNETIC BRAKE COOLING STRUCTURE OF PHASE VARIABLE DEVICE IN CAR ENGINE

FIELD OF THE INVENTION

The invention relates to a cooling structure of an electromagnetic brake of a phase varying apparatus for use with an automobile engine, adapted to vary the valve timing of the engine by applying a retarding or braking force onto a rotational drum of the phase-varying apparatus by electromagnetic break means to vary the rotational phase of the camshaft of the engine relative to the sprocket. More particularly, the invention relates to a cooling structure for cooling an electromagnetic break means that provides a retarding force on the rotational drum of a phase-varying apparatus by circulating engine oil through the apparatus.

BACKGROUND OF THE INVENTION

This type of phase varying apparatus is disclosed in, for example, Japanese Patent Early Publication H4-272411. This apparatus has a movable plate 3 mounted between a drive member (sprocket) 1, to which driving power of a crank shaft of the engine is transmitted, and a camshaft 2 of a valve mechanism, the apparatus configured to vary the relative phase of the drive member 1 and camshaft 2 by axially moving the movable plate 3, as shown in FIG. 11. That is, by means an electromagnetic brake means 4 that is pinned not to rotate, a retarding or braking force is acted on a rotational drum 5 rotatably supported by the camshaft 2 to thereby delaying the rotational drum 5 relative to the drive member 1, which in turn causes an axial movement of the movable plate 3 to rotate the camshaft 2 relative to the drive member 1, resulting in a change in phase between the drive member 1 and camshaft 2. The apparatus is installed inside the engine room of the engine so that it operas in engine oil atmosphere.

The electromagnetic brake means 4 is constituted an annular housing 4*b* having a U-shaped cross section for housing an electromagnetic coil 4*a*, a root member 4*c* for closing an opening of the housing 4*b*, and a friction member 4*d* bonded to the root member 4*c*. This apparatus has a drawback in that when the sliding surfaces of the friction member 4*d* of the housing 4*b* and the rotational drum 5 are heated to a high temperature due to friction between them, the surface of the friction member 4*d* which is generally made of a porous material is clogged with deposits of antioxidant, friction modifier, reactants of additives such as detergent dispersant, and insoluble compositions dispersed in the engine oil, thereby losing frictional torque generated between the friction member 4*d* and the rotational drum 5.

Hence, in order to cool and suppress heating of the sliding surfaces of the friction member 4*d* of the housing 4*b* and the rotational drum 5, the apparatus is provided with an oil passage 6*a*, a cross hole 6*b*, a cavity 6*c*, and a cross hole 6*d* in the camshaft 2, an annular cavity 6*e* formed between the camshaft 2 and the housing 4*b*, and a notch 6*f* formed on the leading edge of the peripheral wall of the housing 4*b* to supply the engine oil to the sliding surfaces of the friction member 4*d* and the rotational drum 5.

Thus, the conventional electromagnetic-brake cooling structure is passably satisfactory in cooling the sliding surface of the friction member.

However, in order to suppress the heating of the sliding surface of the friction member at even higher temperatures, a further innovated efficient cooling measure is necessary.

Thus, the inventor of the present invention has fully examined conventional cooling structures in which the engine oil supplied between the friction member 4*d* and the rotational drum 5 is merely scattered outwardly by a centrifugal force, and has reached a concept of new cooling structure, in which oil lead-out grooves (or notches) are formed in the leading edge of the outer peripheral wall of the housing 4*b* to outwardly drain the oil staying between the sliding surfaces of the friction member 4*d* and the rotational drum 5, so that the amount of oil lead to the sliding sections of the friction member 4*d* and the rotational drum 5 is increased and circulation of the engine oil is enhanced to thereby cool the sliding surfaces. In fact, it is found in numerous experiments that this inventive structure is effective.

In view of the prior art problems and the inventor's finding as mentioned above, it is an object of the invention to provide a cooling structure effective in suppressing heating of the sliding surfaces of the friction member and the rotational drum of an electromagnetic-brake of a phase-varying apparatus for use with an automobile engine, the cooling structure adapted to enhance the circulation of engine oil to cool the sliding surfaces.

SUMMARY OR THE INVENTION

To attain the objects described above, there is provided a structure for cooling an electromagnetic brake (referred to as electromagnetic-brake cooling structure) of a phase varying apparatus for use with an automobile engine, as defined in claim 1, the phase varying apparatus including:

an annular sprocket to which the driving power of the crank shaft of the engine is transmitted;

a camshaft constituting a valve mechanism, the camshaft coaxial with, and slidable relative to, the annular sprocket;

a rotational drum rotatably supported by the camshaft; and an electromagnetic brake means, mounted at an axial position to face the rotational drum, for applying a retarding force onto the rotational drum such that the retarding force causes a delay in rotational motion of the rotational drum to vary the phase of the camshaft relative to the sprocket, the electromagnetic brake means including: an annular clutch case pinned not to rotate about its axis and having a U-shaped cross section with its open end facing a disc-shaped surface of the rotational drum; an electromagnetic coil housed in the clutch case; a plate for holding a friction member (hereinafter referred to as friction member holding plate) fixed inside the opening of the clutch case; and a generally flat friction member bonded to the friction member holding plate and having a surface slightly projecting from the leading edges of the inner and outer circular walls of the clutch case, wherein an oil sump is formed inside the clutch case, the oil sump communicating with the oil passage of the camshaft and with the inner peripheries of the sliding sections of the clutch case and rotational drum;

oil lead-in notches are formed in the leading edge of the inner peripheral wall of the clutch case to introduce thereinto engine oil;

the engine oil is lead from the oil sump to the sliding surfaces of the friction member and rotational drum via the oil lead-in notches, and wherein oil lead-out notches are formed in the leading edge of the outer circular wall of the clutch case to outwardly lead the engine oil from the sliding surfaces of the friction member and rotational drum to the outside of the of the clutch case.

A structure for delaying the rotational motion of the rotational drum behind the sprocket by a retarding force of an electromagnetic brake means for causing an intermediate member to shift in the axial direction so that the phase of the camshaft is varied relative to the sprocket, can be attained by an inventive arrangement in which an intermediate member 30 threadedly engaged with a rotational drum 44 and undergoes internal and external helical spline engagement with both a sprocket (external cylinder 10) and a camshaft (inner cylinder 20).

(FUNCTION) In this arrangement, the sprocket to which the driving power of the engine is transmitted by a crank shaft is adapted to rotate integrally with, and in synchronism with, a camshaft that functions as a valve mechanism, in such a way that when a retarding force is acted on the rotational drum by the electromagnetic brake means, the drum is delayed in rotation behind the sprocket, resulting in a change in phase of the camshaft with respect to the sprocket. Engine oil is introduced to the sliding sections of the friction member and the rotational drum via an oil passage formed in the camshaft, an oil sump provided formed in a radially small section of the clutch case, and the oil lead-in notches formed in the leading edge of the inner peripheral wall of the clutch case in order to cool the sliding surfaces of the friction member and the rotational drum. It should be noted that the engine oil is supplied to and drained from the sliding surfaces of the friction member and the rotational drum at a higher flow rate via the oil lead-out notches formed in the leading edge of the outer circular wall of the clutch case to enhance the drainage of the oil from the sliding sections to the outside of the clutch case, which facilitates cooling of the sliding surfaces. That is to say, the amount of oil introduced into the sliding sections is increased by the amount led out of the sliding sections, resulting in enhanced circulation of the engine oil through the sliding sections and corresponding cooling effect on the friction member and the rotational drum.

In another aspect of the invention as defined in claim 2, there is provided an electromagnetic-brake cooling structure of a phase varying apparatus for use in an automobile engine, wherein oil lead-out holes are provided in the disc surface of the rotational drum at positions facing the friction member so that the oil staying in the sliding sections of the friction member and the rotational drum is led out through the oil lead-out holes.

(FUNCTION) In this arrangement, the oil staying in the sliding sections is also led out therefrom to the outside through the oil lead-out hole, thereby increasing the amount of oil that circulates through the sliding sections.

In an electromagnetic-brake cooling structure of a phase varying apparatus for use in an automobile engine as defined in claim 3, the oil lead-out holes are formed near the outer circular wall of the clutch case.

(FUNCTION) In this arrangement, the amount of oil led out from the sliding sections of the friction member and the rotational drum through the oil lead-out holes is further increased, thereby further increasing the amount of oil led to the sliding sections and enhancing the circulation of the oil. The closer is the old lead-out notch to the oil lead-in notches, the less flow resistance (resulting in energy loss) the flow of oil suffers. Hence, a larger flow rate of oil passing through the oil lead-out holes is obtained. This ensures provision of higher flow rate and circulation rate of fresh engine oil through the sliding surfaces of the friction member.

In an electromagnetic-brake cooling structure of a phase varying apparatus for use in an automobile engine as defined in claim 4, the clutch case is provided with a multiplicity of oil lead-in notches and oil lead-out notches, and the rotational drum is provided with a multiplicity of oil lead-out holes, the notches and holes formed in the multiple circumferential positions.

(FUNCTION) The amount of engine oil led into and out of the sliding sections of the friction member and the rotational drum is multiply increased by the increment in number of the oil lead-in notches, oil lead-out notches, and the oil lead-out holes, which in turn enhances the circulation of the engine oil through the sliding sections of the friction member and the rotational drum, and hence the cooling of the sliding surfaces of the friction member and the rotational drum.

In an electromagnetic-brake cooling structure of a phase varying apparatus for use in an automobile engine as defined in claim 5, the friction member has an annular face adapted to abut against the base plate of the rotatable drum, and is provided on the face with oil grooves that communicate with the oil lead-out notches.

(FUNCTION) The engine oil introduced to the sliding sections of the friction member and the rotational drum smoothly flows into the oil grooves and into the oil lead-out notches, resulting in an increased flow rate, thereby uniformly cooling the entire surface of the friction member and enhancing the circulation of the oil.

In addition, since the oil can easily circulate via the oil grooves on the surface of the friction member, transition from fluid lubrication to boundary lubrication can be easily attained, which enhances frictional torque acting on the surfaces of the friction member and the rotational drum, thereby increasing the retarding force acting on the rotational drum when the electromagnetic brake means is energized.

In an electromagnetic-brake cooling structure for use in an automobile engine as defined in claim 6, there are provided annular gaps formed between the inner and outer circular walls of the clutch case and the inner and outer peripheries of the friction member.

(FUNCTION) The engine oil introduced through the oil lead-in notches passed through the gaps (or oil passages) between the inner peripheral wall and the friction member, and spreads over the entire circumferential area of the friction member. The oil staying in the sliding sections of the friction member and the rotational drum smoothly flows through the gaps (oil passage) between the outer circular wall of the clutch case and the friction member and led out from the oil lead-out notches.

In an electromagnetic-brake cooling structure for use in an automobile engine as defined in claim 7, the friction member is made of a non-woven fabric of carbon fiber and/or aramid fiber impregnated with a heat-hardening resin, in the form of a porous member containing at least 80 volume percent of all the pores having pore diameters in the range of 5–100 $\mu$m.

(FUNCTION) Since the porous member thus formed has more than 80 volume percent of all pores being in the range from 5 to 100 $\mu$m in pore size, it is less likely to be clogged, thereby creating a large frictional (retarding) torque acting on the disc surface of the rotational drum. In addition, the friction member has good abrasion resistance and hence excellent durability.

THE BEST MODE FOR CARRYING OUT THE INVENTION

Figure 1:
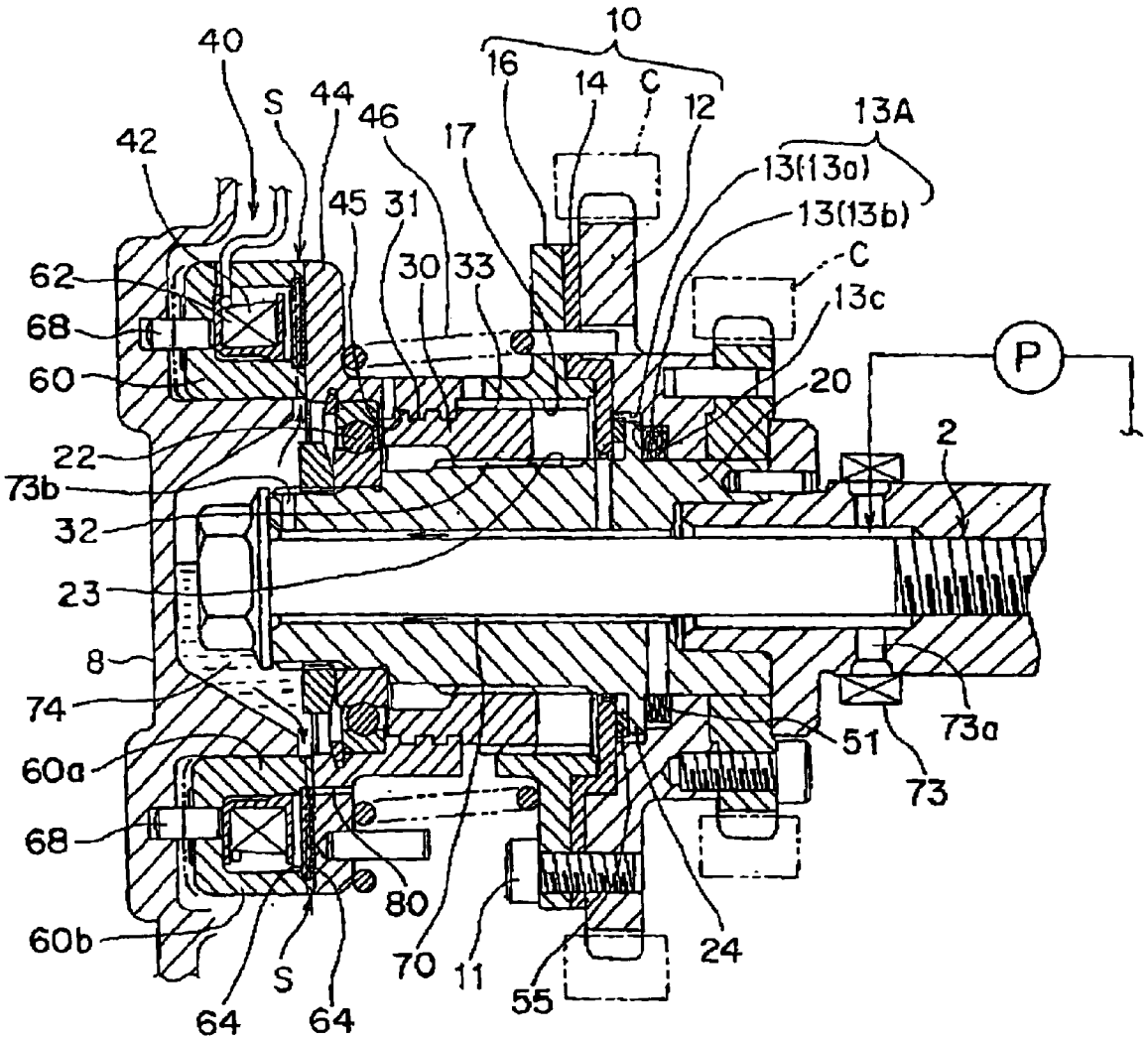
FIG. 1 is a longitudinal cross sectional view of a first embodiment of a phase-varying apparatus of an automobile engine according to the invention.
Figure 2:
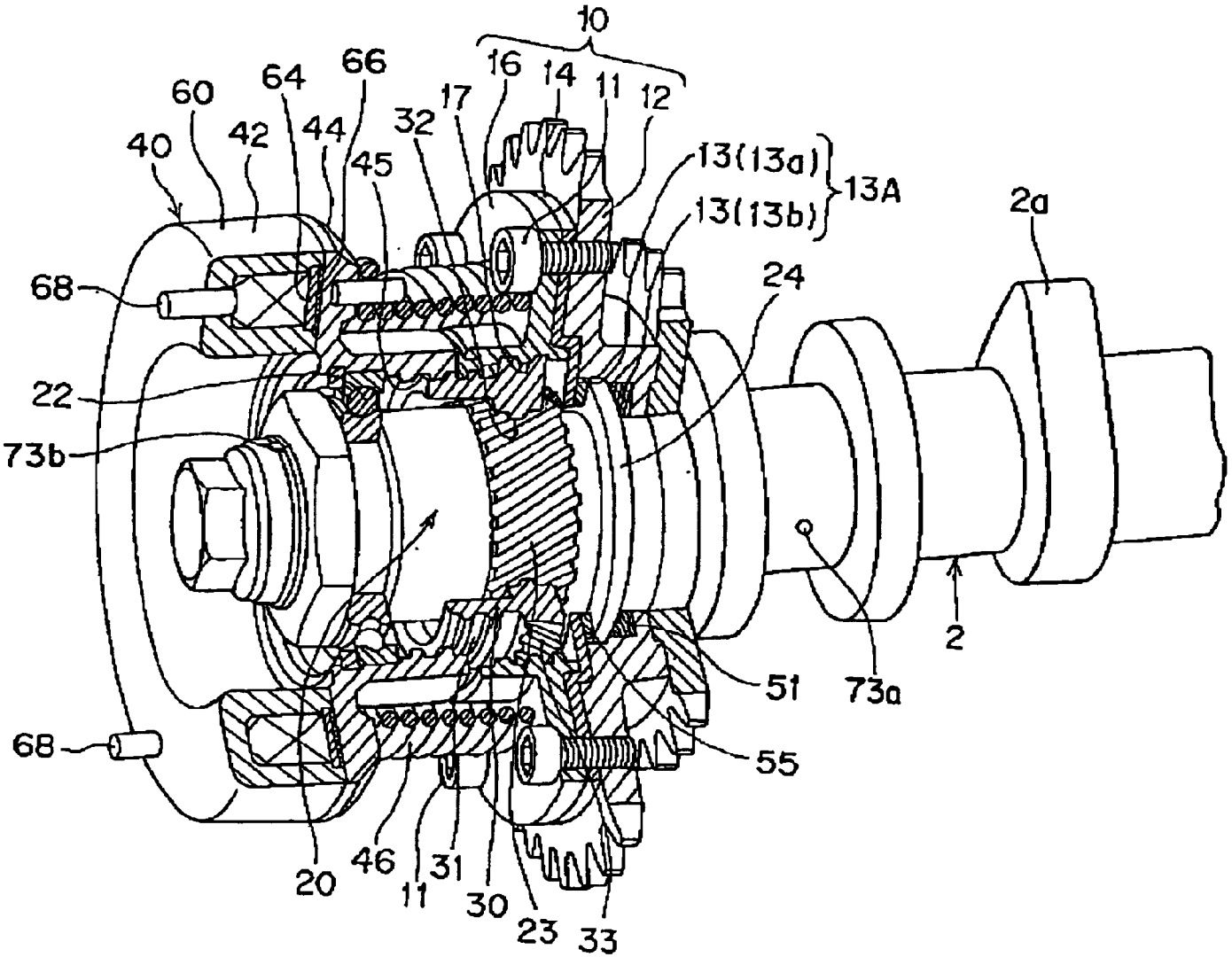
FIG. 2 is a perspective view of the apparatus shown in FIG. 1, showing the internal structure of the apparatus.
Figure 3:
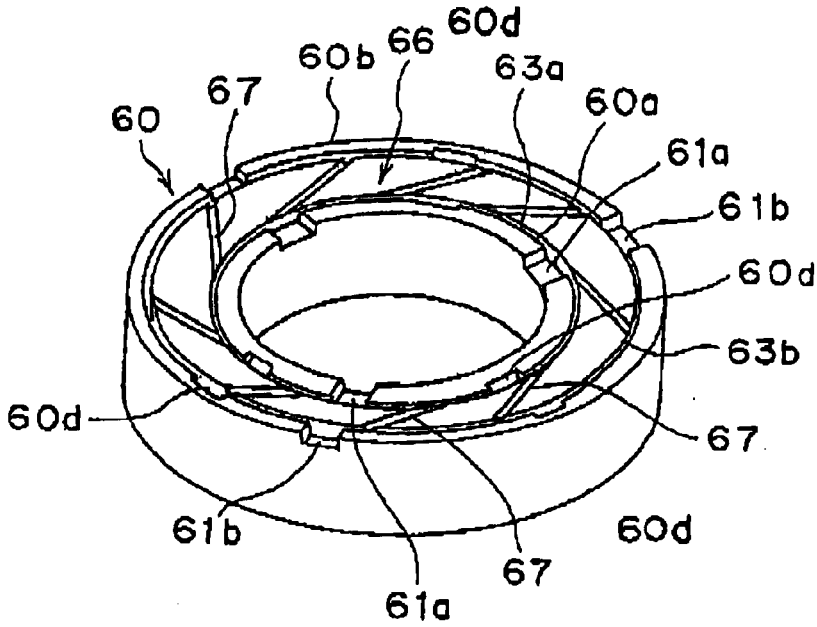
FIG. 3 is a perspective view of an electromagnetic clutch constituting a main portion of electromagnetic brake means.
Figure 4:
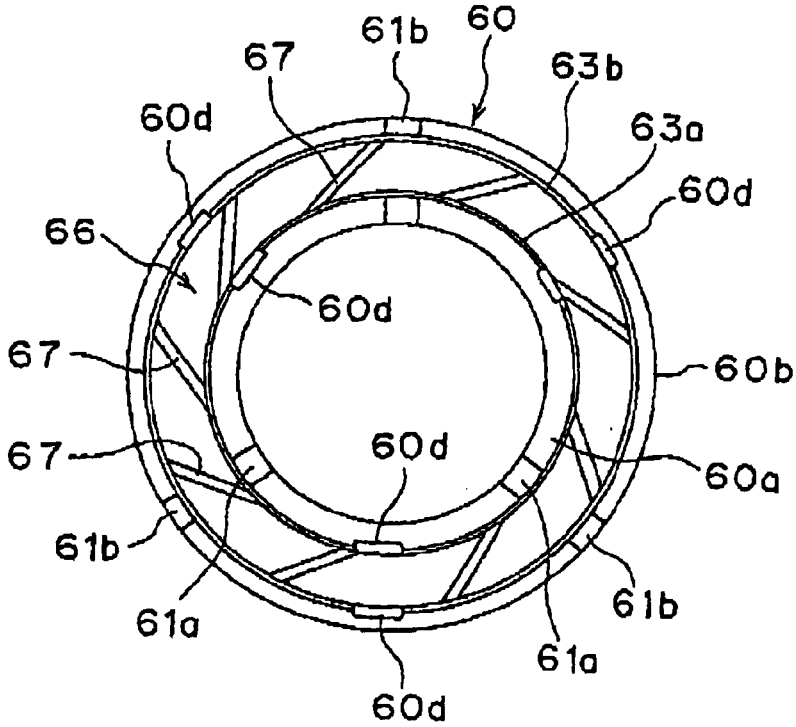
FIG. 4 is front view of the electromagnetic clutch shown in FIG. 3.
Figure 5A:
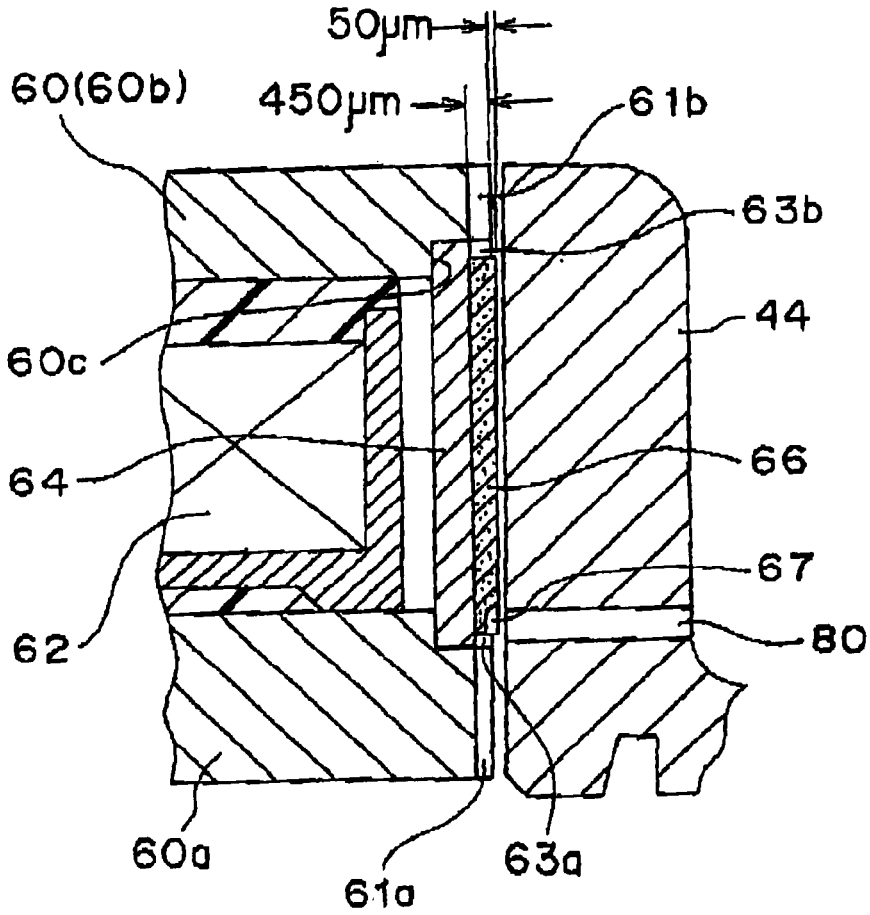
FIGS. 5(*a*)–(*b*) are respectively an enlarged cross sectional view of the sliding sections of the friction member and the rotational drum shown in FIG. 4, showing the cross sections taken in the plane passing through oil lead-out notches and the cross section taken in the plane passing through caulking of the rotational drum.
Figure 5B:
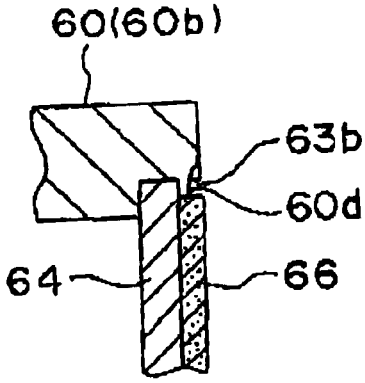

We explain the embodiment of the invention next. Referring to FIGS. 1–6, there is shown a first embodiment of a phase varying apparatus of the invention. Particularly, FIG. 1 shows a longitudinal cross section of a first embodiment of a phase-varying apparatus of the invention; FIG. 2, a perspective view of the apparatus showing the internal structure of the apparatus; FIG. 3, a perspective view of an electromagnetic clutch constituting a main portion of electromagnetic brake means; FIG. 4, a front view of the electromagnetic clutch. FIG. 5(*a*), an enlarged cross section of the sliding sections of the friction member and the rotational drum taken in the plane passing through oil lead-out notches, and FIG. 5(*b*) a cross section of the same sliding sections taken in the plane passing through caulking positions; and FIG. 6, a perspective view of the rotational drum.

The phase varying apparatus as shown in these figures is incorporated integrally in an engine to transmit the rotation of the crankshaft to a camshaft of the engine to open and close the intake and exhaust valves of the engine in synchronism with the crankshaft. the apparatus adapted to vary valve timing of the intake and exhaust valves in accordance with the operational conditions of the engine, i.e. depending on the load and the rotational speed of the engine. The apparatus includes: a sprocket in the form of an (annular) external cylinder 10 to which the driving force of the engine is transmitted via the clank shaft, and an (annular) inner cylinder 20 that forms a part of a camshaft 2 coaxial with the external cylinder 10 and movable relative to the external cylinder 10 as a follower; an intermediate member 30 mounted between, and in helical spline engagement with, the external cylinder 10 and inner cylinder 20, for varying the phase of the inner cylinder 20 relative to the external cylinder 10 as the intermediate member 30 undergoes an axial movement; and an electromagnetic brake means 40 provided on one end of the inner cylinder 20 remote from a cam 2*a* on the camshaft 2, for axially shifting the intermediate member 30. An engine case 8 is a cover for phase varying apparatus. The engine and the phase varying apparatus are operated in engine oil atmosphere.

The external cylinder 10 comprises a sprocket's main body (referred to as sprocket main body) 12 having on the periphery thereof a recess 13; an inner flange plate 14 in close contact with the sprocket main body 12 and defining a flange engagement groove 13A in collaboration with the recess 13; a spline case 16 force-fitting the inner flange plate 14 into the sprocket main body 12 and having on the periphery thereof a section that maintains spline engagement with the intermediate member 30. A reference numeral 13*a* represents a diametrically larger recessed section formed in the opening of the recess 13; reference numeral 13*b*, a diametrically smaller recessed section formed in the bottom of the recess 13; a step 13*c* is formed between the diametrically larger and smaller recessed sections 13*a* and 13*b*, respectively to face the outer periphery of a flange 24 of the inner cylinder 20 (described later). Rotation of the crankshaft of the engine is transmitted to the external cylinder 10 (sprocket main body 12) by means of a chain C. Reference numeral 11 represents a fastening screw for securely uniting the sprocket main body 12, the internal flange plate 14, and the spline case 16. It is noted that a flange engaging groove 13A with which the flange 24 engages can be easily formed by constructing the sprocket 10 using the sprocket main body 12, the inner flange plate 14, and the spline case 16. and that a spline engaging section 17 can be easily formed on the external cylinder 10 (spline case 16).

Reference numerals 32 and 33 represents female and male helical splines, respectively, formed on the inner and outer peripheral surfaces of the intermediate member 30; reference numeral 23, male helical spline formed on the outer peripheral surface of the inner cylinder 20; reference numeral 17, female helical spline formed on the inner circumferential surface of the spline case 16. The inner and outer splines 32 and 33 of the intermediate member 30 are reverse helical splines adapted to move the innter cylinder 20 in the opposite axial direction relative to the external cylinder 10 in response to a small axial movement of the intermediate member 30 to thereby vary the phase of the inner cylinder 20 greatly relative to the external cylinder 10. Formed on the outer peripheral surface of the intermediate member 30 are square male threads 31.

The electromagnetic brake 40 includes an electromagnetic clutch 42 mounted on the engine case 8; a rotational drum 44 to which the retarding force of the electromagnetic clutch 42 is transmitted, the rotational drum 44 rotatably supported by bearings 22 on the inner cylinder 20 and engaging with the male threads 31 of the intermediate member 30; and an axially extending torsion coiled spring 46 mounted between the rotational drum 44 and the external cylinder 10. Reference numeral 45 represents female square threads formed on the inner circumferential surface of the rotational drum 44 such that the rotational drum 44 and the intermediate member 30 can rotate in the circumferential direction along the square threads 45 and 31. That is, the intermediate member 30 can move in the axial direction while rotating along the square threads 45 and 31. The rotational drum 44 and the external cylinder 10 are coupled by a wound torsion coiled spring 46. When no retarding force is acting on the rotational drum 44, the external cylinder 10, the inner cylinder 20, the intermediate member 30, and the rotational drum 44 rotate as a single unit. Since the torsion coiled spring 46 mounted between the rotational drum 44 and the external cylinder 10 (spline case 16) can extend axially, it remains compact in the radial direction while extending in the axial direction.

By controlling the ON-OFF operation of the electromagnetic clutch 42 and the amount of electric current supplied to the electromagnetic clutch 42, the axial displacement of the intermediate member 30 along the square threads 45 and 31, and hence the phase relationship between the external cylinder 10 and the inner cylinder 20, can be varied to adjust the valve timing by the cam 2*a*. When the electromagnetic clutch 42 is not actuated, it is located at a position as shown in FIG. 1 by a phantom line, leaving a space S between the rotational drum 44 and the electromagnetic clutch 42, and since there is no phase difference between the external cylinder 10 and the inner cylinder 20, they rotate together. As the electromagnetic clutch 42 is actuated, it is attracted to the rotational drum 44 (to the right as seen in FIG. 1), thereby acting a retarding force on the rotational drum 44. The retarding force causes a rotational delay of the rotational drum 44 behind the external cylinder 10, which, under the action of the threads 31 and 45, in turn causes the intermediate member 30 to advance (to the right as seen in FIG. 1). This in turn causes, under the actions of the inner and outer helical splines 32 and 33, the inner cylinder 20 (camshaft 2) to rotate with respect to the external cylinder 10 (sprocket main body 12), thereby change its phase relative to the external cylinder 10. The rotational drum 44 is held in position where the transmitted retarding force balances out the spring force of the torsion coiled spring 46, with a predetermined phase difference between the inner cylinder 20 and the external cylinder 10.

On the other hand, when the electromagnetic clutch 42 is disabled, no retarding force is transmitted to the rotational drum 44. The intermediate member 30, solely under the spring force of the coiled springs 46, is retracted back to the original position by means of the male threads 31 and 45 (to the left as seen in FIG. 1). Meanwhile, the inner cylinder 20 (camshaft 2) rotates in the reverse direction with respect to the external cylinder 10 (sprocket main body 12) so as to nullify the phase difference between the external cylinder 10 and inner cylinder 20.

The flange 24 is formed on the outer peripheral surface of the inner cylinder 20 (i.e. on the surface in sliding contact with the sprocket main body 12), and the flange engaging groove 13A with which the flange 24 engages is formed on the peripheral surface of the external cylinder 10 (sprocket main body 12). Mounted between the sides of the flange 24 and the flange engaging groove 13A are friction members 51 and 55 (referred to as frictional torque enhancing member) for increasing the frictional torque generated by the friction between the sliding sections of the external cylinder 10 and the inner cylinder 20, whereby the noises generated by the colliding gear teeth of the engaging sections 23, 32, 33, and 17 of the intermediate member 30 and the external cylinder 10 and inner cylinder 20 in helical spline engagement are suppressed.

Next, the structure of the electromagnetic clutch 42 that constitutes the electromagnetic brake 40 and the cooling structure of the sliding surfaces of the friction member 66 provided on the surface of the electromagnetic clutch 42 and the rotational drum 44 will now be described.

As shown in FIGS. 3–5, the electromagnetic clutch 42 comprises an annular clutch case 60 pinned no to rotate and having a U-shaped cross section with its open end facing the disc face of the rotational drum 44; an electromagnetic coil 62 contained in the clutch case 60; a metallic friction member holding plate 64 fixed on the inside of the opening of the clutch case 60; and a flattened friction member 66 bonded to the friction member holding plate 64 and having a surface slightly projecting from the front edges of the inner and outer circular walls 60*a* and 60*b*, respectively, of the clutch case 60. Reference numeral 68 represents pins that protrude at multiple angular positions on the back side of the clutch case 60, adapted to engage with bores 8*a* formed in one side of the engine case 8 so as to allow the clutch case 60 to slide in the axial direction but not in the angular direction.

The electromagnetic coil 62 is fixed within the clutch case 60 by a molded resin. The friction member holding plate 64, integrated with the friction member 66, is positioned at the step section 60*c* inside the opening of the clutch case 60, and secured in position on the inner and outer circular walls 60*a* and 60*b*, respectively, of the clutch case 60 by caulking the plate 64 at three angularly equally spaced positions on the circumference thereof. Reference numerals 60*d* shown in FIGS. 3 and 4 indicate the caulking positions. It is noted that the friction member 66 is slightly less than the friction member holding plate 64 in radial width. That is, the inner diameter of the friction member 66 is slightly larger than that of the friction member maintenance plate friction member holding plate 64 and the outer diameter of the friction member 66 is slightly smaller than that of the friction member maintenance plate friction member holding plate 64. This configuration establishes ring shaped grooves 63*a* and 63*b* serving as oil passages between the friction member 66 and the inner and outer peripheral walls 60*a* and 60*b*, respectively, of the clutch case. It should be understood that means for fixing the clutch case 60 of the friction member holding plate 64 is not limited to the caulking as described above, but any known appropriate fixing means including bonding and fitting may be equally used.

The friction member 66 is a form of porous plate of 500 $\mu$m in thickness, made of a paper substrate impregnated with a heat-hardening resin, for creating friction (retarding force) when it comes into contact with the disk face of the rotational drum 44 when the electromagnetic clutch 42 is actuated. The friction member 66 protrudes from the leading edges of the inner and outer circular walls 60*a* and 60*b*, respectively, of the clutch case 60.

Engine oil is constantly supplied to the sliding surfaces of the friction member 66 of the electromagnetic clutch 42 and the rotational drum 44 to suppress heating of the sliding surfaces.

Specifically, as shown in FIG. 1, an oil sump 74 is defined by the engine case 8 is provided in a radially small section of the clutch case 60. The oil sump 74 communicates with an oil passage 70 formed in the camshaft 2 and with circumference of the sliding sections of the clutch case 60 and the rotational drum 44. The engine oil is injected by a pump P into the oil passage 70 in the camshaft 2 via the oil port of the journal bearings 73 for the camshaft 2 and side holes 73*a* formed in the camshaft 2. Reference numeral 73*b* represents a side hole formed in the camshaft 2, communicating with the oil passage 70 and the oil sump 74. Provided at the leading edge of the circumferential wall 60*a* of the clutch case are oil lead-in notches 61*a* for introducing oil onto the sliding surfaces of the friction member 66 and the rotational drum 44. On the other hand, formed at the leading edge of the outer circular wall 60*b* of the clutch case are oil lead-out notches 61*b* for draining the engine oil from the sliding surfaces of the friction member 66 and the rotational drum 44 to the outside of the clutch case.

It is noted that the engine oil is introduced onto the sliding surfaces of the friction member 66 of the clutch case 60 and the rotational drum 44 via the oil passage 70 formed in the camshaft 2, the oil sump 74 between the engine case 8 and the rotational drum 44 (i.e. bearings 22), and the notches 61*a* formed in the leading edge of the circumferential wall 60*a* of the clutch case, to thereby cool the sliding surfaces of the friction member 66 and the rotational drum 44, and that the engine oil supplied to the sliding surfaces of the friction member 66 and the rotational drum 44 for cooling the sliding surfaces, is positively drained radially outwardly via the oil lead-out notches 61*b* formed in the leading edge of the outer circular wall 60*b* of the clutch case 60. Thus, the supply/drain rate of the engine oil to/from the sliding surfaces of the friction member 66 and the rotational drum 44 is increased accordingly, and the circulation of the oil through the sliding surfaces is enhanced, thereby effectively transferring the heat generated by the sliding surfaces to the circulating oil, i.e. effectively cooling the sliding surfaces.

As seen from FIGS. 3 and 4, there is provided on the surface of the friction member 66 windmill-shaped oil grooves 67 that extend from its inner to the outer circumferences. The oil lead-in notches 61*a* and the oil lead-out notches 61*b* communicate with each other via the annular gaps 63*a*, windmill-shaped oil grooves 67, and annular gaps 63*b*. As a result, the oil introduced to radially inner region of the sliding sections flows smoothly along the oil grooves 67 in the surface of the friction member 66 and lead out of the oil lead-out notches 61*b*, thereby not only facilitating uniform cooling of the entire surface of the friction member 66 but also increasing the amount of oil lead in and out of the sliding sections and enhancing the circulation of the oil.

Figure 6:
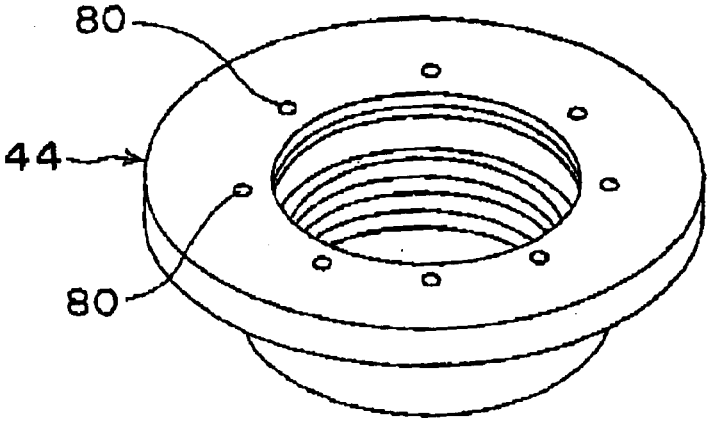
FIG. 6 is a perspective view of the rotational drum shown in FIG. 6.

As shown in FIGS. 5 and 6, there are provided at 8 angularly equally spaced positions on the disk face of the rotational drum 44 facing the friction member 66 and closer to the circumferential wall 60*a* of the clutch case, oil lead-out holes 80 adapted to lead the engine oil from the sliding surfaces to the front end of the rotational drum 44.

The engine oil staying on the sliding surfaces of the friction member 66 and the rotational drum 44 is drained in the radial direction not only from the oil lead-out notches 61*b* at the leading edge of the clutch case but also from the oil lead-out holes 80 of the rotational drum 44 as well, resulting in an increase in the amount of oil that is lead out from the sliding sections and enhancing the circulation of the oil accordingly.

Particularly, because the oil lead-out holes 80 are provided closer to the circumferential wall 60*a* of the clutch case 60, large flow rates of oil are secured. That is, the closer the oil lead-out holes 80 are to the circumferential wall 60*a*, the less the flow resistance of oil, thereby allowing a larger oil lead-out velocity. Thus, it is advantageous to provide the oil lead-out holes 80 close to the circumferential wall 60*a* to obtain a large oil lead out velocity, and hence a higher circulation rate of the oil. This ensures more oil introduced to the sliding surfaces of the friction member 66 and a better cooling effect on the sliding surface.

Figure 7:
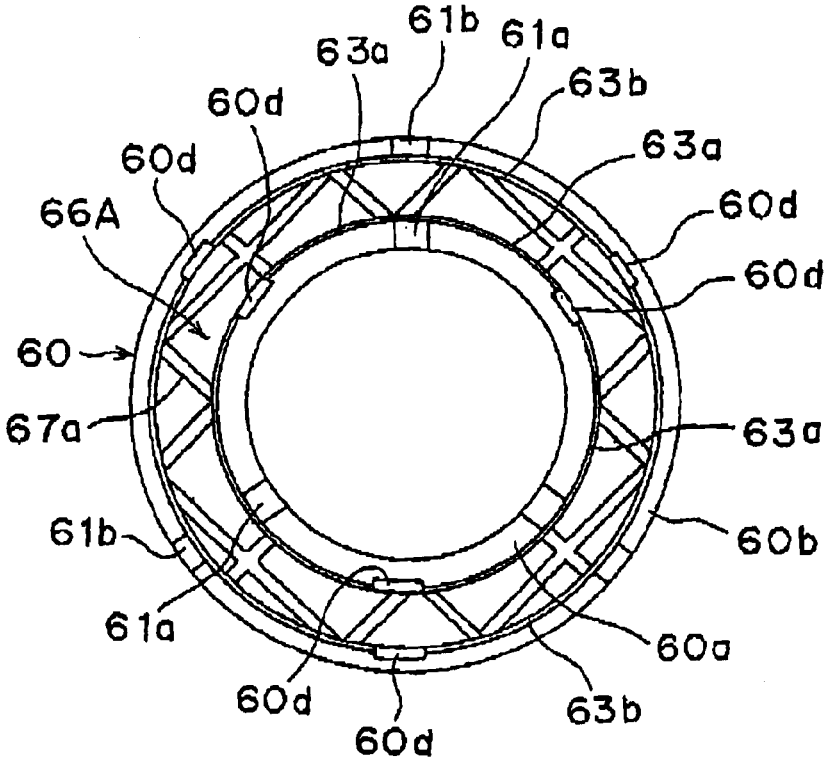
FIG. 7 is a front view of a second embodiment of a phase varying apparatus of an automobile engine according to the invention.
Figure 8:
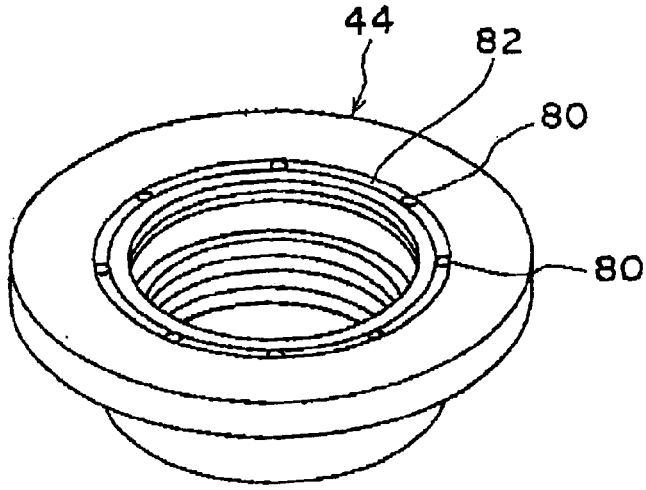
FIG. 8 is a perspective view of the rotational drum of the apparatus.

FIGS. 7 and 8 together show a second embodiment of a phase varying apparatus for use with an automobile engine according to the invention. Particularly, FIG. 7 is a front view of an electromagnetic clutch, which is a main portion of the apparatus. FIG. 8 is a perspective view of a rotational drum, which is also a main portion of the apparatus. Like components in the first and the second embodiments are identified by like reference numerals.

In the second embodiment shown herein, the friction member 66A is made of a non-woven fabric of carbon fiber impregnated with a heat-hardening resin to form a porous member with more than 80 volume percent of all the pores having pore diameters in the range of 5–100 $\mu$m.

This porous member has large pores that are less likely to be clogged, and hence the friction member 66A has excellent durability. This implies that the friction member 66A can maintain a large frictional force (retarding torque) that act on the disk face of the rotational drum over a long period.

Formed in the surface of the friction member 66A are gridironed oil grooves 67*a* capable of supplying engine oil uniformly over the entire surface of the friction member 66A.

On the other hand, the rotational drum 44 is provided on the disk surface thereof with an annular oil passage 82. In addition, the oil passage 82 has a multiplicity of oil lead-out holes 80 which enhance faster flows of oil.

Accordingly, circulation of the engine oil through the space between the sliding surfaces of the friction member 66A and the rotational drum 44 is further enhanced, thereby facilitating cooling of the entire surface of the friction member 66A.

The oil grooves 67*a* of the surface of the friction member increases the frictional torque that acts on the sliding surfaces of the friction member 66A and the rotational drum 44, thereby increasing the retarding force acting on the rotational drum 44 when the electromagnetic clutch 42 is actuated.

This embodiment is the same in the rest of the structure as the first embodiment. Hence, further details of the like components will be omitted.

Figure 9:
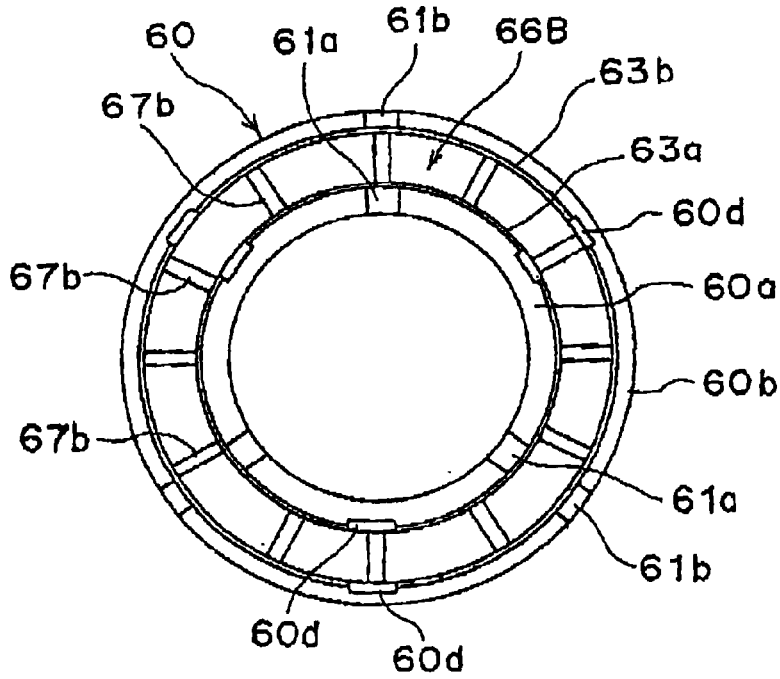
FIG. 9 is a front view of an electromagnetic clutch of a third embodiment of a phase varying apparatus of an automobile engine according to the invention.
Figure 10:
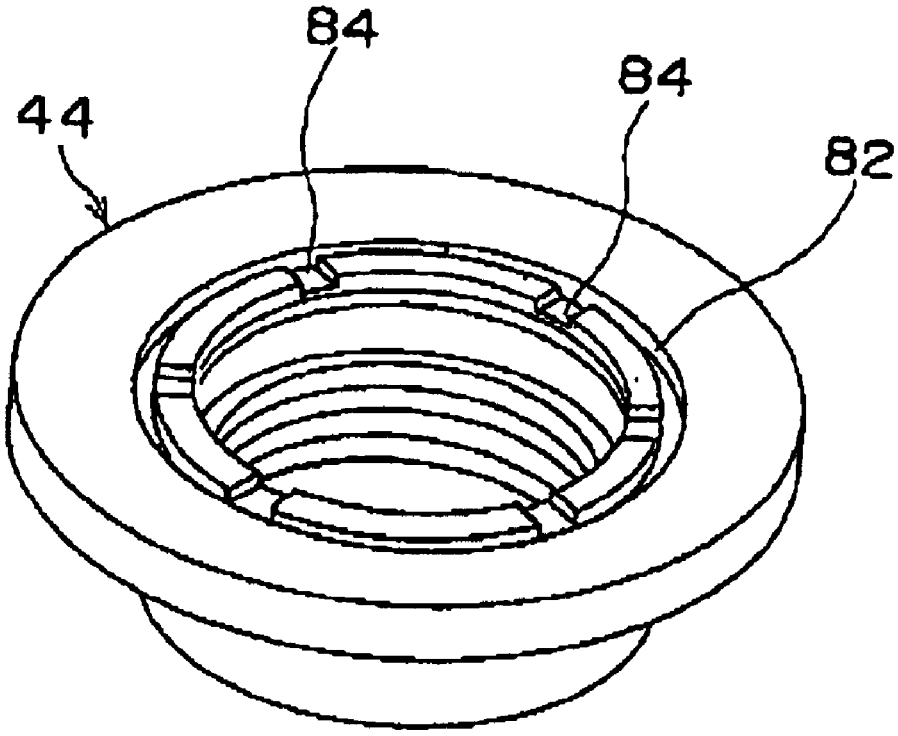
FIG. 10 is a perspective view of the rotational drum, which is a main portion of the apparatus shown in FIG. 9.
Figure 11:
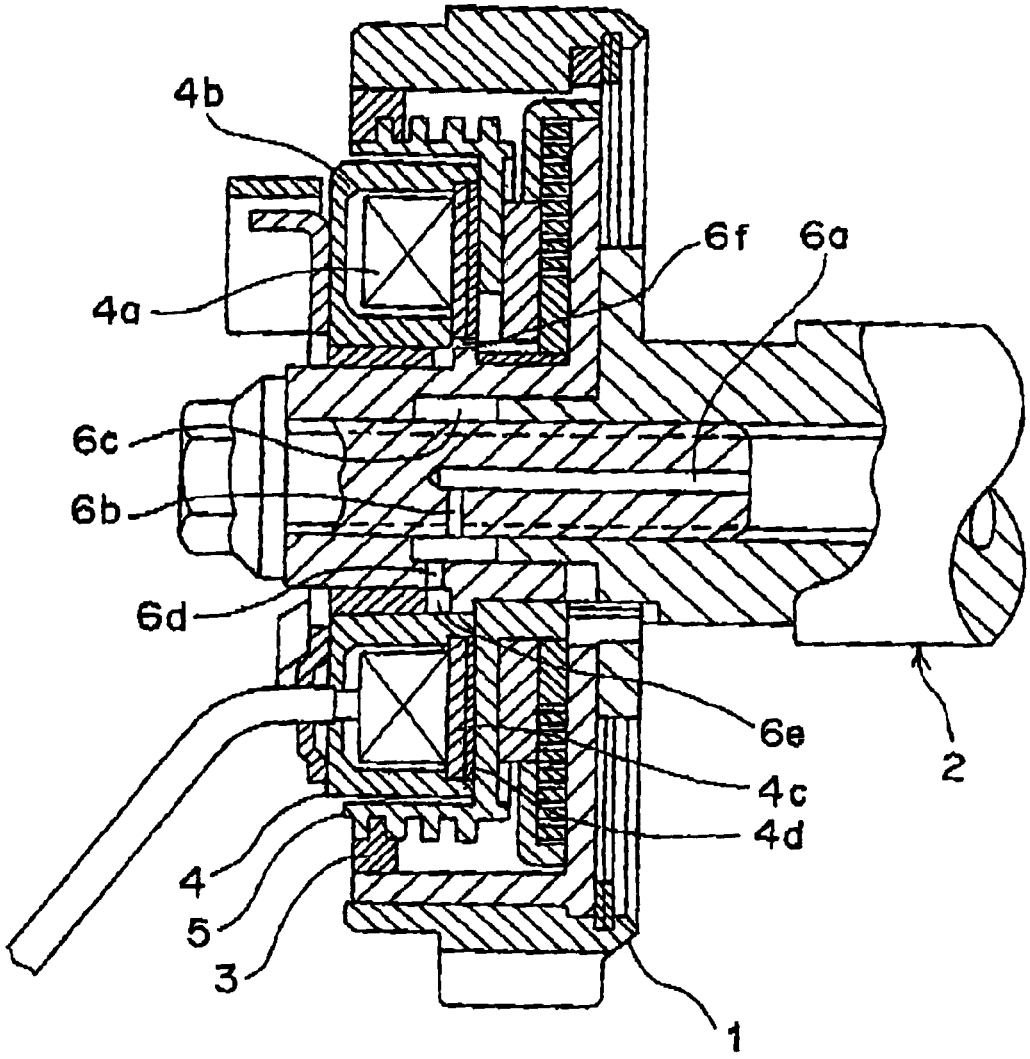
FIG. 11 PRIOR ART
FIG. 11 is a longitudinal cross section of a conventional phase varying apparatus of an automobile engine.

FIGS. 9 and 10 together show a third embodiment of a phase varying apparatus for use with an automobile engine. Particularly, FIG. 9 is a front view of an electromagnetic clutch, which is a main portion of the apparatus. FIG. 10 is a perspective view of a rotational drum, which is another main portion of the apparatus. Like components in the first and the second embodiments are identified by like reference numerals.

In the third embodiment shown herein, the friction member 66B is made of a non-woven fabric of aramid fiber impregnated with a heat-hardening resin to form a porous member with more than 80 volume percent of all the pores having pore diameters in the range of 5–100 $\mu$m.

This porous member has large pores that are less likely to be clogged, and hence the friction member 66B can create a large frictional force (retarding torque) that act on the disk face of the rotational drum. In addition, the friction member 66A has a good durability that it can maintain such large frictional force over a long period.

The friction member 66B is provided on the disk surface thereof with radial oil grooves 67*b* for uniformly providing engine oil over the entire surface of the friction member 66B.

Although the rotational drum 44 is provided on the disk surface thereof with an annular oil passage 82, it is not provided with oil lead-out holes such as ones 80 of the first and second embodiments. The rotational drum 44 is provided with radial oil passages 84 in place of the oil lead-out holes 80.

This embodiment is the same in the rest of the structure as the first embodiment. Hence, further details of the like components will be omitted.

It should be understood that in the above embodiments although the frictional member provided on the front surface of the clutch case 60 for generating a retarding force on the rotational drum 44 is a paper based porous member 66 impregnated with a heat-hardening resin or a form of porous member 66A or 66B of non-woven carbon or aramid fiber impregnated with a heat-hardening resin, the friction member may be made of a porous member of non-woven fabric of carbon and aramid fiber impregnated with a heat-hardening resin.

INDUSTRIAL UTILITY OF THE INVENTION

As described above, in an electromagnetic brake cooling apparatus of the invention as defined in claim 1, circulation of the engine oil in the sliding sections of the friction member and the rotational drum is enhanced, which facilitates cooling of the sliding surface of the friction member, thereby providing a better braking characteristic (breaking performance) of the friction member and the rotational drum under the action of the electromagnetic brake.

In an electromagnetic brake cooling apparatus of the invention as defined in claim 2, circulation of the engine oil in the sliding sections of the friction member and the rotational drum is further enhanced, which further facilitates cooling of the sliding surface of the friction member, thereby providing a still better braking characteristic (breaking performance) of the friction member and the rotational drum under the action of the electromagnetic brake.

In an electromagnetic brake cooling apparatus of the invention as defined in claim 3, supply of the engine oil to, and drainage of the oil from, the sliding sections of the friction member and the rotational drum is further enhanced, which further facilitates cooling of the sliding surface of the friction member, thereby providing a still better braking characteristic (breaking performance) of the friction member and the rotational drum under the action of the electromagnetic brake.

In an electromagnetic brake cooling apparatus of the invention as defined in claim 4, circulation of engine oil through the sliding sections of the friction member and the rotational drum is further enhanced, thereby providing a still better braking characteristic (breaking performance) of the friction member and the rotational drum under the action of the electromagnetic brake.

In an electromagnetic brake cooling apparatus of the invention as defined in claim 5, supply of engine oil to, and drainage of the oil from, the sliding sections of the friction member and the rotational drum is further enhanced, which facilitates uniform cooling of the entire sliding surfaces of the friction member and the rotational drum, preventing them from being heated to a high temperature, thereby providing good braking characteristics (breaking performance) of the friction member and the rotational drum under the action of the electromagnetic brake.

In an electromagnetic brake cooling apparatus of the invention as defined in claim 6, gaps formed between the inner and outer circular walls of the clutch case and the friction member serve as oil passages facilitating smooth supply and drainage of engine oil to and from the sliding sections of the friction member and the rotational drum, which enhances the circulation of the oil through the sliding sections, and provides a good braking characteristic (breaking performance) of the friction member and the rotational drum under the action of the electromagnetic brake.

In an electromagnetic brake cooling apparatus of the invention as defined in claim 7, the friction member is made of a porous material having pores of large pore diameters which are less likely to be clogged. Hence, the friction member has good durability and can provide a large frictional force (breaking torque) to the rotational drum over a long period.

What is claimed is:

1. An electromagnetic-brake cooling structure of a phase varying apparatus for use with an automobile engine, said phase varying apparatus including:

an annular sprocket to which the driving power of the crank shaft of said engine is transmitted;

a camshaft coaxial with, and slidable relative to, said annular sprocket, said camshaft constituting a valve mechanism;

a rotational drum rotatably supported by said camshaft; and an electromagnetic brake means mounted at an axial position facing said rotational drum for applying a retarding force onto said rotational drum such that said retarding force causes a delay in rotational motion of said rotational drum to vary the phase of said camshaft relative to said sprocket, said electromagnetic brake means including:

an annular clutch case pinned not to rotate about its axis and having a U-shaped cross section with its open end facing a disc-shaped surface of said rotational drum;

an electromagnetic coil housed in said clutch case;

a plate for holding a friction member (friction member holding plate) fixed inside the opening of said clutch case; and a generally flat friction member bonded to said friction member holding plate and having a surface slightly projecting from the leading edges of the inner and outer circular walls of said clutch case;

an oil sump formed in a radially small section of said clutch case, said oil sump communicating with an oil passage of said camshaft and with the radially inner potions of the sliding sections of said clutch case and rotational drum;

oil lead-in notches formed in the leading edge of the inner circular wall of said clutch case to lead engine oil from said oil sump to the sliding surfaces of said friction member and rotational drum via said oil lead-in notches, wherein oil lead-out notches are formed in the leading edge of the outer wall of said clutch case to outwardly lead said engine oil from said sliding surfaces of said friction member and rotational drum to the outside of said of the clutch case.

2. The electromagnetic-brake cooling structure according to claim 1, wherein oil lead-out holes are provided in the disc surface of said rotational drum at positions facing said friction member so that the oil staying in said sliding sections of the friction member and the rotational drum is led out through said oil lead-out holes.

3. The electromagnetic-brake cooling structure according to claim 2, wherein said oil lead-out holes are formed near the outer circumferential wall of the clutch case.

4. The electromagnetic-brake cooling structure according to claim 2, wherein said clutch case is provided with a multiplicity of oil lead-in notches and oil lead-out notches, and said rotational drum is provided with a multiplicity of oil lead-out holes, said notches and holes formed at multiple circumferential positions.

5. The electromagnetic-brake cooling structure according to claim 1, wherein said friction member has an annular face adapted to abut against the base plate of said rotational drum, and is provided on said face with oil grooves that communicate with said oil lead-out notches.

6. The electromagnetic-brake cooling structure according to claim 1, further comprising annular gaps formed between the inner and outer circular walls of said clutch case and the inner and outer peripheries of said friction member.

7. The electromagnetic-brake cooling structure according to claim 1, wherein said friction member is made of a non-woven fabric of carbon fiber and/or aramid fiber impregnated with a heat-hardening resin, in the form of a porous member containing at least 80 volume percent of all the pores having pore diameters in the range of 5–100 $\mu$m.

* * * * *